US008882305B2

(12) United States Patent
Sasaki et al.

(10) Patent No.: US 8,882,305 B2
(45) Date of Patent: Nov. 11, 2014

(54) BULB-TYPE LAMP AND LUMINAIRE

(75) Inventors: Jun Sasaki, Yokosuka (JP); Ryotaro Matsuda, Yokosuka (JP); Naoto Mori, Yokosuka (JP); Yoshiyuki Matsunaga, Yokosuka (JP); Hideki Okawa, Yokosuka (JP); Takeo Yasuda, Yokosuka (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 54 days.

(21) Appl. No.: 13/601,264

(22) Filed: Aug. 31, 2012

(65) Prior Publication Data

US 2013/0300277 A1 Nov. 14, 2013

(30) Foreign Application Priority Data

May 11, 2012 (JP) ..... 2012-109648

(51) Int. Cl.
*F21V 3/00* (2006.01)
*F21V 5/00* (2006.01)

(52) U.S. Cl.
USPC ..... 362/311.06; 362/257; 313/116

(58) Field of Classification Search
CPC ..... F21V 3/02
USPC ..... 313/116, 318.12
See application file for complete search history.

(56) References Cited

U.S. PATENT DOCUMENTS

| | | | | |
|---|---|---|---|---|
| 2010/0177496 | A1 | 7/2010 | Gillies et al. | |
| 2010/0314996 | A1 | 12/2010 | Van De Ven et al. | |
| 2011/0026246 | A1 * | 2/2011 | Holten et al. | 362/230 |
| 2011/0169431 | A1 | 7/2011 | Li | |

FOREIGN PATENT DOCUMENTS

| | | |
|---|---|---|
| JP | 2010-205553 | 9/2010 |
| JP | 2010-257761 | 11/2010 |
| JP | 2011-253901 | 12/2011 |
| WO | 2009/128004 A1 | 10/2009 |

OTHER PUBLICATIONS

European Office Action dated Jan. 13, 2013, filed in European counterpart Application No. 12181897.5, 6 pages.

* cited by examiner

*Primary Examiner* — Anh Mai
*Assistant Examiner* — Zachary J Snyder
(74) *Attorney, Agent, or Firm* — Patterson & Sheridan LLP

(57) ABSTRACT

According to one embodiment, in a constricted part of a globe, one end is set to a minimum diameter, the other end is set to a maximum diameter, and a diameter thereof increases from the one end side to the other end side. The constricted part of the globe is concaved into the inside of an imaginary straight line connecting an outer edge of the one end and an outer edge of the other end when viewed in section. A light source part includes a semiconductor light-emitting element and is contained in the globe so that a light-emitting part is positioned between both the ends of the constricted part of the globe. A cap is positioned on one end side of the globe.

17 Claims, 7 Drawing Sheets

(a)

(b)

BULB-TYPE LAMP AND LUMINAIRE

INCORPORATION BY REFERENCE

The present invention claims priority under 35 U.S.C. §119 to Japanese Patent Application No. 2012-109648 filed on May 11, 2012. The content of the application is incorporated herein by reference in their entirety.

FIELD

Embodiments described herein relate generally to a bulb-type lamp including a light source part which includes a semiconductor light-emitting element and is contained in a globe, and a luminaire including the same.

BACKGROUND

Hitherto, there is a bulb-type lamp which can be substituted for a bulb using a filament and in which an LED as a semiconductor light-emitting element is used as a light source. The bulb-type lamp as stated above includes a board on which the LED element is mounted to form the light source, and a globe is attached to cover the board. In the bulb-type lamp as stated above, in order to relax the uncomfortable feeling caused by a difference between the light-emitting positions of the LED element and the filament bulb, an optical system is sometimes provided inside or outside the globe.

DESCRIPTION OF THE DRAWINGS

FIG. 4(*b*) is a characteristic curve view of the bulb-type lamp in a state where a diffusion globe is used.

FIG. 5(*b*) is a characteristic curve view of the bulb-type lamp shown in FIG. 5(*a*).

FIG. 6(*b*) is a characteristic curve view of the bulb-type lamp shown in FIG. 6(*a*).

FIG. 7(*b*) is a characteristic curve view of the bulb-type lamp shown in FIG. 7(*a*) in a state where a transmission globe is used.

FIG. 8(*b*) is a characteristic curve view of the bulb-type lamp shown in FIG. 8(*a*) in a state where a diffusion globe is used.

DETAILED DESCRIPTION

In general, according to one embodiment, a bulb-type lamp includes a globe including a constricted part, a light source part and a cap. One end of the constricted part is set to a minimum diameter, the other end thereof is set to a maximum diameter, a diameter thereof increases from the one end side to the other end side, and the constricted part is concaved into the inside of an imaginary straight line connecting an outer edge of the one end and an outer edge of the other end when viewed in section. The light source part includes a semiconductor light-emitting element, and a light-emitting part is positioned between both the ends of the constricted part of the globe and is contained in the globe. The cap is positioned on one end side of the globe.

Hereinafter, embodiments will be described with reference to the drawings.

Figure 1:
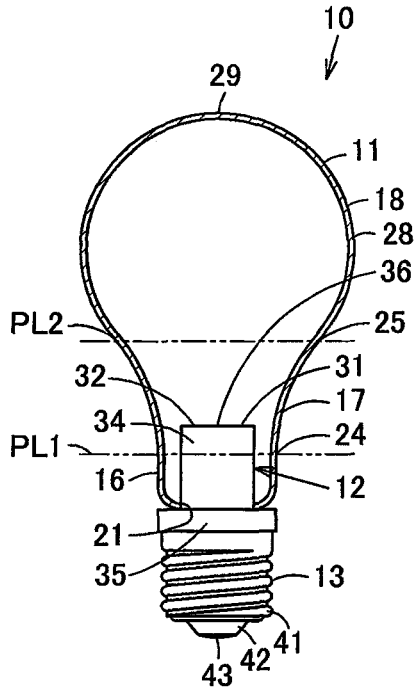
FIG. 1 is a partially cut-away side view showing a bulb-type lamp of an embodiment.
Figure 2:
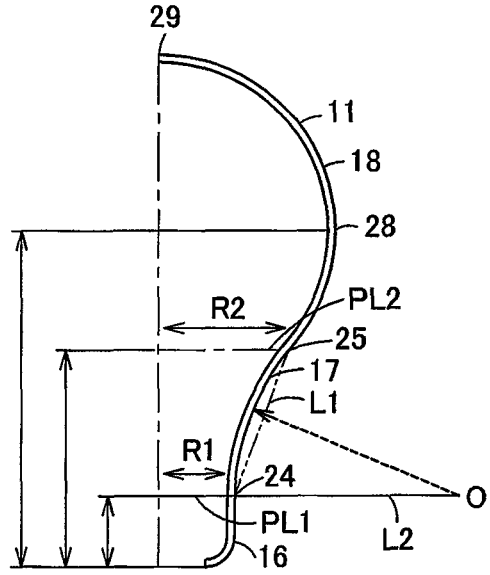
FIG. 2 is a sectional view schematically showing a globe of the bulb-type lamp.

In FIG. 1 and FIG. 2, a bulb-type lamp 10 includes a globe 11, a light source part 12 contained in the globe 11, and a cap 13 attached to one end part of the globe 11.

The globe 11 is integrally formed of a material such as synthetic resin or glass, and includes a straight part 16 which is a base end part as the one end part connected to the cap 13, a constricted part 17 which is an intermediate part continuous with the other end side of the straight part 16, and a spherical part 18 which is a tip part as the other end part continuous with the other end side of the constricted part 17. The globe has a rotator shape in which the center axis is a straight line passing through the centers of the straight part 16, the constricted part 17 and the spherical part 18. In the globe 11, the length in a direction of a lamp axis as the center axis and the outer diameter of a maximum diameter portion in a direction crossing the lamp axis direction are equal to those of an incandescent lamp for general illumination, and the globe is formed in a shape close to the shape of the incandescent lamp in whole. Incidentally, according to the required luminous intensity distribution characteristic of the bulb-type lamp 10, the globe 11 may be a translucent globe (clear globe) which allows most of the light from the light source part 12 to pass through without diffusion, or a diffusion globe which diffuses the light from the light source part 12.

The straight part 16 is formed in a straight cylindrical shape, and includes an opening part 21 at one end side opposite to the cap 13. The size of the straight part 16 in the axial direction along the lamp axis is set to, for example, about 12 mm, and the size of the inner diameter thereof is set to, for example, about 15 to 18 mm.

The constricted part 17 is a coupling part to smoothly couple the straight part 16 and the spherical part 18. One end 24 continuous with the straight part 16 is set to a minimum diameter R1, and the other end 25 continuous with the spherical part 18 is set to a maximum diameter R2. The constricted part has a tube shape in which the diameter thereof increases from the one end 24 side to the other end 25 side. Further, in the constricted part 17, an inclination (curvature) gradually increases from, for example, the one end 24 side to the other end 25 side, and the constricted part has an S-shape concaved to the inside (lamp axis side) of an imaginary straight line L1 connecting an outer edge of the one end 24 and an outer edge of the other end 25 when viewed in section. In other words, the curvature of the constricted part 17 is changed between the one end 24 and the other end 25 so that the curvature at the one end 24 is equal to the curvature of the straight part 16 having the straight cylindrical shape, and the curvature at the other end 25 is equal to the curvature of the spherical part 18. Besides, when viewed in section, the constricted part 17 has an arc shape having a specific radius (for example, 35 mm), in which the center thereof is the center of curvature O positioned on an imaginary straight line L2 orthogonal to, for example, a lamp axis and passing through the one end 24, and has a substantially smooth curved surface having no flat part and no inflection point. Incidentally, the size of the constricted part 17 in the axial direction along the lamp axis is set to, for example, about 24 mm. Besides, the inner diameter size at the one end 24, which is the minimum diameter R1 of the constricted part 17, is equal to that of the straight part 16, and is set to, for example, about 15 to 18 mm. The inner diameter size at the other end 25, which is the Maximum diameter R2, is smaller than the maximum diameter of the spherical part 18 and is set to, for example, about 25 mm.

Accordingly, in the constricted part 17, the maximum diameter R2 is set to be, for example, 1.5 to 2.5 times the minimum diameter R1.

The spherical part 18 is formed in a spherical shape continuous with the other end 25 of the constricted part 17.

The diameter thereof gradually increases from the other end 25 of the constricted part 17 in the direction outward from the other end and to a maximum diameter position (equatorial position) 28, and the diameter gradually decreases from the maximum diameter position 28 to a top 29. Incidentally, the maximum inner diameter of the spherical part 18 is set to, for example, about 30 to 32.5 mm.

In the light source part 12, a semiconductor light-emitting element 31 as a solid light-emitting element, such as, for example, an LED element or an EL element, is mounted on a base body 32, and the light source part is formed as a surface light source. In this embodiment, the LED element is used as the semiconductor light-emitting element 31. The base body 32 includes a board part 34 which is a mount part mounted with the semiconductor light-emitting element 31 and is inserted from the opening part 21 of the globe 11 into the globe 11, and a flange-shaped positioning part 35 which is sandwiched between the edge of the opening part 21 of the globe 11 and the cap 13 and positions the light source part 12 with respect to the globe 11. In the light source part 12, a COB (Chip On Board) type in which plural LED elements are mounted on the board part 34 is adopted. That is, the plural LED elements are mounted on the board part 34, and the plural LED elements are electrically connected in series by wire bonding. The plural LED elements are integrally covered with a phosphor layer including a transparent resin, such as silicone resin, in which phosphor is mixed. An LED element to emit, for example, blue light is used as the foregoing LED element. The phosphor which is excited by part of the blue light from the LED element and emits yellow light is mixed in the phosphor layer. Accordingly, in the light source part 12, the surface of the semiconductor light-emitting element 31 covered with the phosphor layer becomes a light-emitting part 36, and white illumination light is emitted from the light-emitting part 36. The light-emitting part 36 of the semiconductor light-emitting element 31 of the light source part 12 is positioned between the one end 24 and the other end 25 of the constricted part 17 in the globe 11. Here, that the light-emitting part 36 of the semiconductor light-emitting element 31 is positioned between the one end 24 and the other end 25 of the constricted part 17 means that the light-emitting part is positioned between an imaginary surface PL1 including the one end 24 of the constricted part 17 and orthogonal to the lamp axis and an imaginary surface PL2 including the other end 25 and orthogonal to the lamp axis, or is positioned on the imaginary surface PL1 or PL2.

The cap 13 is connected to a socket for a general illumination bulb and enables power feeding from an external power supply, and is attached to the straight part 16 of the globe 11 so as to cover the opening part 21. The cap 13 includes a shell part 41 formed in a cylindrical shape with a bottom by a member such as conductive metal, an insulating part 42 provided at the other end side of the shell part 41, and an eyelet 43 provided at the top of the insulating part 42. Besides, a not-shown lighting circuit part for lighting the light source part 12 is contained inside the shell part 41 of the cap 13. In the lighting circuit, a circuit element is mounted on a board and, for example, a constant current circuit to supply constant current to the light source part 12 is formed. The lighting circuit is electrically connected to the shell part 41 and the eyelet 43 by not-shown lead wires for input, and is electrically connected to the light source part 12 by a not-shown lead wire for output.

When the bulb-type lamp 10 is assembled, the light source 12 is inserted in the opening part 21 of the globe 11, and the positioning part 35 of the base body 32 is fixed to the edge of the opening part 21. In this state, the light source part 12 and the globe 11 are positioned, and the light-emitting part 36 of the semiconductor light-emitting element 31 of the light source part 12 is positioned between the one end 24 and the other end 25 of the constricted part 17 of the globe 11.

Besides, the lighting circuit part is electrically connected to the shell part 41 and the eyelet 43 of the cap 13 by a pair of lead wires, and while the lighting circuit part is contained inside the cap 13, the cap 13 is attached so that the light source part 12 is sandwiched between the cap and the globe 11.

Figure 3:
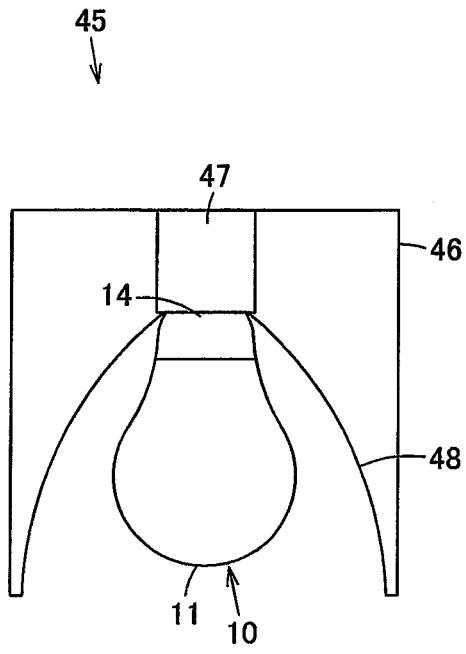
FIG. 3 is an explanatory view showing a luminaire including the bulb-type lamp.

FIG. 3 shows a luminaire 45 as a downlight using the bulb-type lamp 10. The luminaire 45 includes a luminaire main body 46. A socket 47 for mounting the bulb-type lamp 10 and a reflector 48 for downward reflecting the light emitted from the bulb-type lamp 10 are disposed in the luminaire main body 46.

When the bulb-type lamp 10 is mounted to the socket 47 of the luminaire 45 and power is applied, the light circuit part operates, and electric power is supplied to the semiconductor light-emitting elements 31 of the light source part 12. Then, the plural semiconductor light-emitting elements 31 are lit, and the light is emitted from the light-emitting part 36. The light passes through the globe 11 and is emitted to the outside.

Heat generated at the time of lighting of the plural semiconductor light-emitting elements 31 of the light source part 12 and heat generated by the operation of the lighting circuit part are mainly conducted from the light source part 12 to the globe 11 and the cap 13, and is radiated to the outside from the globe 11 and the cap 13.

Figure 5:
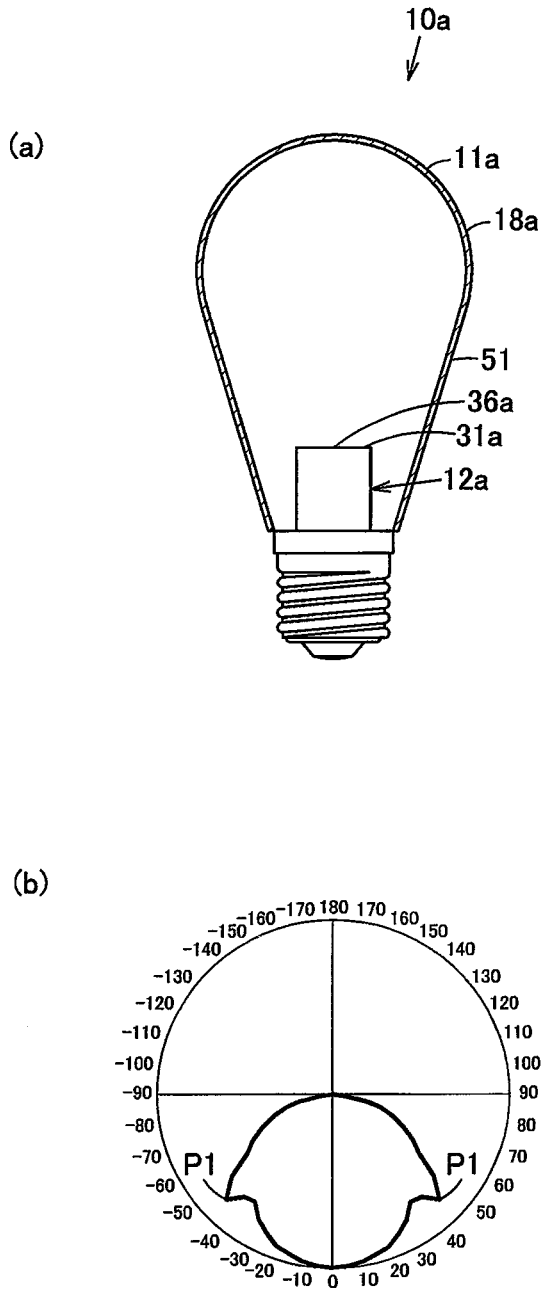
FIG. 5(*a*) is a partially cut-away side view showing a bulb-type lamp including a globe having no constricted part, which is a first comparative example to the above bulb-type lamp.

Here, for example, as shown in FIG. 5(*a*), in a bulb-type lamp 10*a* in which a globe 11*a* does not include a constricted part and includes a diameter increasing part 51 with a diameter linearly increasing from one end side to a spherical part 18*a*, when the globe 11*a* is a transmission globe to allow light to pass through, in the diameter increasing part 51, a difference in angle of light emission from a light-emitting part 36*a* of a semiconductor light-emitting element 31*a* of a light source part 12*a* is equal to a difference in incidence angle. Thus, if the difference in angle of light emission is small, the difference in outgoing angle from the globe 11*a* is also small. Accordingly, as shown in FIG. 5*b*, remarkable peaks P1 and P1 appear in the luminous intensity distribution, and ring-shaped unevenness in luminous intensity distribution occurs at the positions corresponding to the peaks P1 and P1.

Figure 6:
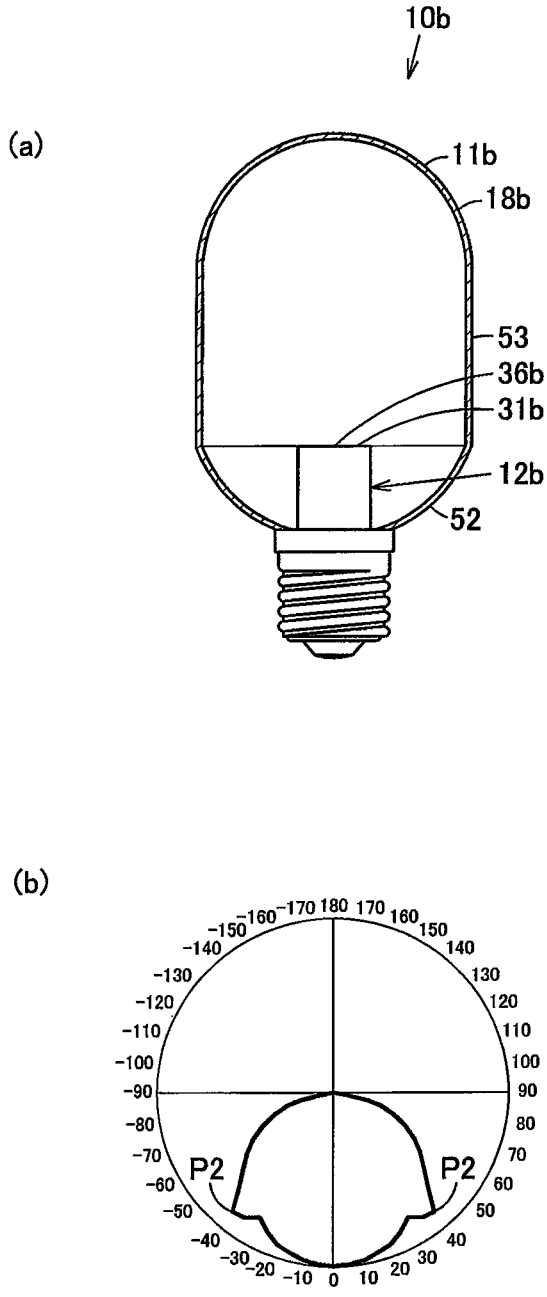
FIG. 6(*a*) is a partially cut-away side view showing a bulb-type lamp including a globe having no constricted part, which is a second comparative example to the above bulb-type lamp.

Similarly, for example, as shown in 6*a*, in a bulb-type lamp 10*b* in which a globe 11*b* includes, instead of the constricted part 17, a diameter increasing part 52 with a diameter increasing so as to protrude outward from one end side to the other end side, and includes a cylindrical straight part 53 linearly continuous with a spherical part 18*b* from the diameter increasing part 52, when the globe 11*b* is a translucent globe to allow light to pass through, in the straight part 53, a difference in angle of light emission from a light-emitting part 36*b* of a semiconductor light-emitting element 31*b* of a light source part 12*b* is equal to a difference in incidence angle. Thus, if the difference in angle of light emission is small, the difference in outgoing angle from the globe lib is also small. Accordingly, as shown in FIG. 6(*b*), remarkable peaks P2 and P2 appear in the luminous intensity distribution, and ring-shaped unevenness in luminous intensity distribution occurs at the positions corresponding to the peaks P2 and P2.

Figure 7:
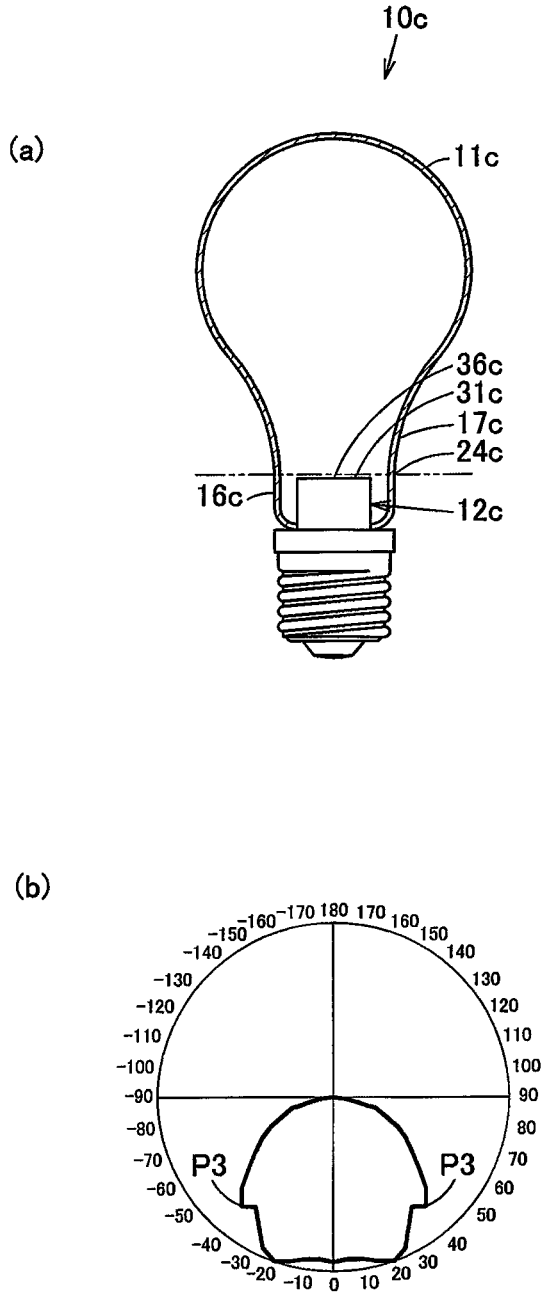
FIG. 7(*a*) is a partially cut-away side view showing a bulb-type lamp which is a third comparative example to the above bulb-type lamp and in which a light-emitting part of a light source part is positioned closer to one end side than a constricted part.

Further, for example, as shown in FIG. 7(*a*), in a bulb-type lamp 10*c* in which a light-emitting part 36*c* of a semiconductor light-emitting element 31*c* of a light source part 12*c* is positioned closer to a straight part 16*c* side (one end side) than one end 24*c* of a constricted part 17*c*, when the globe 11*c* is a transmission globe to allow light to pass through, a considerable amount of light from the light-emitting part 36*c* is incident on the straight part 16*c*, and in the straight part 16*c*, a difference in angle of light emission from the light-emitting part 36*c* of the semiconductor light-emitting element 31*c* of the light source part 12*c* is equal to a difference in incidence angle. Thus, if the difference in angle of light emission is small, the difference in outgoing angle from the globe 11*c* is also small. Accordingly, as shown in FIG. 7(*b*), remarkable peaks P3 and P3 appear in the luminous intensity distribution, and ring-shaped unevenness in luminous intensity distribution occurs at the positions corresponding to the peaks P3 and P3.

On the other hand, in the bulb-type lamp 10 of the embodiment, when the globe 11 is a translucent globe to allow light to pass through, a considerable amount of light from the light-emitting part 36 is incident on the constricted part 17, and in the constricted part 17, even if the angle in light emission from the light-emitting part 36 slightly varies, the incidence angle to the globe 11 significantly varies. Thus, the outgoing angle of light from the globe 11 significantly varies, and as shown in FIG. 4(*a*), although slight peaks P4 and P4 appear in the luminous intensity distribution, unevenness in luminous intensity distribution hardly occurs.

Figure 8:
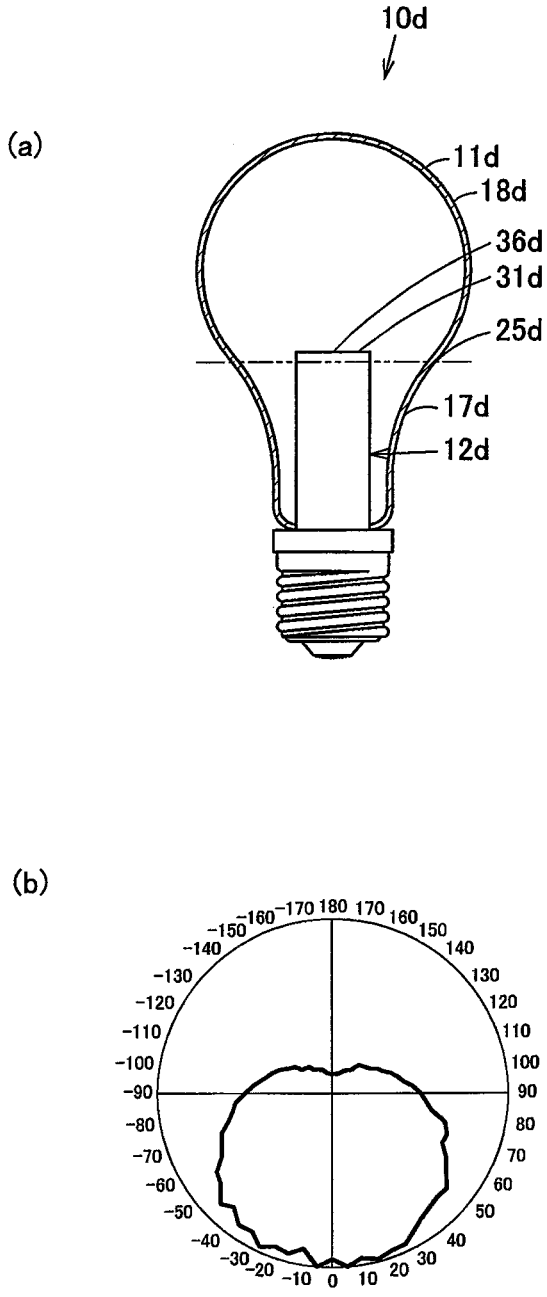
FIG. 8(*a*) is a partially cut-away side view showing a bulb-type lamp which is a fourth comparative example to the above bulb-type lamp and in which a light-emitting part of a light source part is positioned closer to the other end side than a constricted part.

Besides, for example, as shown in FIG. 8(*a*), in a bulb-type lamp 10*d* in which a light-emitting part 36*d* of a semiconductor light-emitting element 31*d* of a light source part 12*d* is positioned closer to a spherical part 18*d* side (other end side) than other end 25*d* of a constricted part 17*d*, when a globe 11*d* is a diffusion globe to diffuse light, as shown in FIG. 8(*b*), the luminous intensity distribution is not sufficiently extended.

Figure 4:
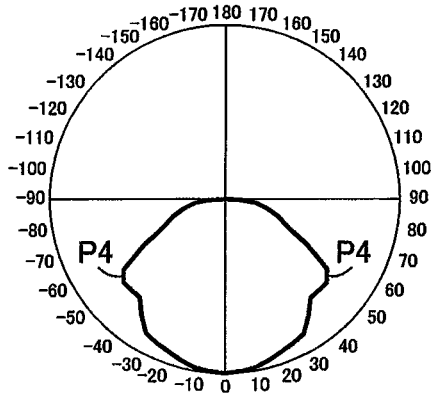
FIG. 4(*a*) is a characteristic curve view of the bulb-type lamp in a state where a translucent globe is used.
Figure 4:
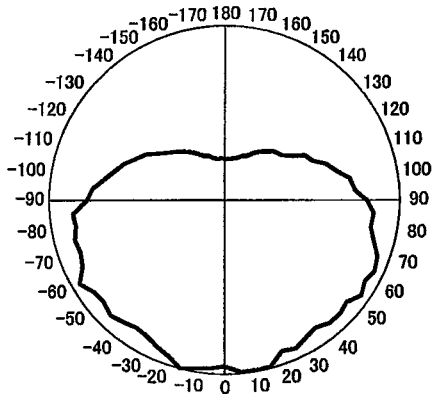

On the other hand, in the bulb-type lamp 10 of the embodiment, when the globe 11 is a diffusion globe to diffuse light, as shown in FIG. 4(*b*), the luminous intensity distribution is extended to about 240°, and the luminous intensity distribution can be widened.

As described above, the light-emitting part 36 of the light source part 12 including the semiconductor light-emitting element 31 is arranged between both the ends of the constricted part 17 of the globe 11, in which the one end 24 is set to the minimum diameter and the other end 25 is set to the maximum diameter, and which is formed so that the diameter increases from the one end 24 side to the other end 25 side and is concaved into the inside of the imaginary straight line L1 connecting the outer edge of the one end 24 and the outer edge of the other end 25 when viewed in section. Accordingly, the occurrence of unevenness in luminous intensity distribution can be almost suppressed by the simple structure without using an optical system or the like in the inside or outside of the globe 11, and when the globe 11 is made a diffusion globe, the luminous intensity distribution can be easily widened.

Besides, if the maximum diameter R2 of the constricted part 17 is set to be 1.5 to 2.5 times the minimum diameter R1, the constricted part 17 can be constructed in which the light from the light source part 12 is not concentrated on a specific position and can be more effectively diffused, and the occurrence of unevenness in luminous intensity distribution can be more effectively suppressed. When the globe 11 is made a diffusion globe, the luminous intensity distribution can be easily widened.

The luminaire 45 excellent in luminous intensity distribution and having wide luminous intensity distribution can be provided by providing the bulb-type lamp 10 as described above.

Incidentally, although the constricted part 17 has the curved surface along the arc in which the center O of curvature is the center when viewed in section, the constricted part may not necessarily have the curved shape along the arc, and may have, instead of a curved surface having a single center O of curvature, a curved shape formed of curved surfaces having plural centers O of curvature.

Besides, the constricted part 17 may include a few flat parts as long as a substantially curved surface is formed. Further, if the globe 11 has a shape having at least the constricted part 17, for example, a shape having a flat light projecting part may be adopted instead of the spherical part 18.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

What is claimed is:

1. A bulb-type lamp comprising:

a globe including a constricted part, a straight part, and a spherical part, the constricted part having in a tubular shape with gradually increasing diameters between first and second ends thereof, a diameter at the second end thereof being about 1.5 to 2.5 times a diameter at the first end thereof, an outer surface of the constricted part being curved inward towards a lamp axis extending through central portions of the straight part, the constricted part, and the spherical part, the straight part being continuous with the first end of the constricted part and having a constant diameter along the lamp axis that is equal to the diameter of the first end of the constricted part, and the spherical part being in a spherical shape and continuous with the second end of the constricted part;

a light source part that is continuous with the constricted part and including a semiconductor light-emitting element contained in the globe and positioned so that a light-emitting end thereof is between the first and second ends of the constricted part; and a cap disposed at one end of the globe.

2. The lamp of claim 1, wherein the globe is a translucent globe.

3. The lamp of claim 1, wherein the globe is a diffusion globe.

4. The lamp of claim 1, wherein the constricted part has a substantially smooth curved outer surface without a flat part and an inflection point.

5. The lamp of claim 1, wherein a diameter at the second end of the constricted part is about 15 mm to 18 mm.

6. The lamp of claim 1, wherein a diameter at the first end of the constricted part is about 25 mm.

7. The lamp of claim 1, wherein the light source part includes a chip-on-board type surface light source having a plurality of semiconductor light-emitting elements.

8. The lamp of claim 1, wherein the light source part is configured to emit a white illumination light.

9. The lamp of claim 1, wherein the semiconductor light-emitting element is an LED element.

10. A luminaire comprising:

a luminaire main body including a socket; and a bulb-type lamp having a globe, a cap, and a light source part, the globe including a constricted part having a tubular shape so as to have with gradually increasing diameters between first and second ends thereof, a diameter at the second end thereof being about 1.5 to 2.5 times a diameter at the first end thereof, an outer surface of the constricted part being curved inward towards a lamp axis, a straight part being continuous with the first end of the constricted part and having a constant diameter along the lamp axis that is equal to the diameter of the first end of the constricted part, and a spherical part being in a spherical shape and continuous with the second end of the constricted part, the lamp axis extending through central portions of the straight part, the constricted part, and the spherical part, the cap being disposed at one end of the globe and mounted in the socket, and a light source part that is continuous with the constricted part and including a semiconductor light-emitting element contained in the globe and positioned so that a light-emitting end thereof is between the first and second ends of the constricted part.

11. The luminaire of claim 10, further comprising a reflector which is arranged in the luminaire main body to reflect light emitted from the bulb-type lamp.

12. A light-emitting device comprising:

a globe including first, second, and third parts having a tubular shape, the first part being formed to have gradually increasing diameters between first and second ends thereof, a diameter at the second end of the first part being about 1.5 to 2.5 times a diameter at the first end of the first part, and an outer surface of the first part being that is curved inward towards a lamp axis extending through the first, second, and third parts, the second part being disposed at a first end side of the first part and having a constant diameter section in which distance from the lamp axis is constant along the lamp axis, and the third part being disposed at a second end side of the first part and including a spherical part formed in a spherical shape;

a semiconductor light-emitting unit housed within the globe and positioned such that a light-emitting end of the semiconductor light-emitting unit is between the first and second ends of the first part; and a cap disposed at one end of the globe.

13. The device of claim 12, wherein the globe is a translucent globe.

14. The device of claim 12, wherein the globe is a diffusion globe.

15. The device of claim 12, wherein the first part has a substantially smooth curved outer surface without a flat part and an inflection point.

16. The device of claim 12, wherein the semiconductor light-emitting unit includes a plurality of semiconductor light-emitting elements mounted on a board.

17. The device of claim 12, wherein the semiconductor light-emitting unit is configured to emit white illumination light.

* * * * *